US009320397B2

(12) United States Patent
Gottschall et al.

(10) Patent No.: US 9,320,397 B2
(45) Date of Patent: Apr. 26, 2016

(54) VACUUM CLEANER WITH SLIDING LATCH

(71) Applicant: SHOP VAC CORPORATION, Williamsport, PA (US)

(72) Inventors: Jason Gottschall, South Williamsport, PA (US); Melvin E. Wolfe, Jr., Johnson City, NY (US)

(73) Assignee: SHOP VAC CORPORATION, Williamsport, PA (US)

( * ) Notice: Subject to any disclaimer, the term of this patent is extended or adjusted under 35 U.S.C. 154(b) by 319 days.

(21) Appl. No.: 13/938,645

(22) Filed: Jul. 10, 2013

(65) Prior Publication Data

US 2015/0013100 A1 Jan. 15, 2015

(51) Int. Cl.

| | |
|---|---|
| ***A47L 5/36*** | (2006.01) |
| ***A47L 9/00*** | (2006.01) |
| ***A47L 9/14*** | (2006.01) |
| ***A47L 7/00*** | (2006.01) |

(52) U.S. Cl.

CPC ..... *A47L 5/365* (2013.01); *A47L 7/0019* (2013.01); *A47L 9/0027* (2013.01); *A47L 9/14* (2013.01)

(58) Field of Classification Search

CPC ..... A47L 9/009; A47L 5/362; A47L 9/242; A47L 5/365; A47L 7/0019; A47L 9/0027; A47L 9/14

See application file for complete search history.

(56) References Cited

U.S. PATENT DOCUMENTS

| | | | | |
|---|---|---|---|---|
| 7,841,043 | B2 * | 11/2010 | Fernandez-Grandizo Martinez et al. | 15/327.2 |
| 2011/0056045 | A1 * | 3/2011 | Sepke et al. | 15/347 |
| 2013/0255030 | A1 * | 10/2013 | Meredith et al. | 15/347 |

* cited by examiner

*Primary Examiner* — Robert Scruggs

(74) *Attorney, Agent, or Firm* — Marshall, Gerstein & Borun LLP

(57) ABSTRACT

A latch mounts in an opening on the lidcage of a conventional vacuum cleaner. A stationary piece has a hooked arm that locks against an edge on the lidcage, and can be clipped in place without other fasteners. It also has a hose fence that helps hold a stored hose. A movable piece has a tongue that slides within a channel on the stationary piece. When locked, the tongue engages the bead and a lock latches onto an edge, inhibiting the tongue from moving to the unlocked position. The lock is on an actuator tab that extends from the stationary piece and can be deflected by a user to release the lock. A spaced finger edge may be engaged by a user while pressing the actuator tab. A barb on the tongue engages the same edge that the lock latches onto, and resists removal of the tongue from the channel.

10 Claims, 7 Drawing Sheets

VACUUM CLEANER WITH SLIDING LATCH

CROSS-REFERENCE TO RELATED APPLICATIONS

Not applicable.

BACKGROUND OF THE INVENTION

The present invention relates generally to vacuum cleaners, and more particularly to latches used to secure a removable lidcage to the tank of a wet/dry vacuum. Such lidcages house the vacuum source and fit on and close the open upper end of the tank. Many such vacuum cleaners have a pair of openings on the lidcage that accommodate prior art latches that latch onto latch lower bases on the tank.

BRIEF SUMMARY

The applicants have developed a new latch that is easy and inexpensive to manufacture and install on a conventional wet/dry vacuum cleaner. The new latch includes two pieces, one of which is a stationary latch that fits into the opening on a conventional lidcage.

The stationary latch has two spaced edges that fit against outer peripheral surfaces on the lidcage and hold the stationary latch against the exterior of the lidcage. A resilient hooked arm on the stationary latch deflects over and then locks against an interior edge on the lidcage, subsequently inhibiting the stationary latch from being withdrawn from the exterior of the removable lidcage and thus enabling each stationary latch to be clipped in place on the lidcage without the use of other fasteners. The stationary latch may also have a hose fence that extends vertically upwardly above the open end of the tank, defining a hose space in which a hose can be mounted between the hose fence and the walls that encompass the vacuum source.

The second piece of the new latch is a latch clasp that has a tongue that mounts within a channel in the stationary latch for sliding movement along a length of the channel between a locked position and an unlocked position. A barb on one part of the tongue resists removal of the tongue from the channel after the tongue has been mounted. In the locked position, a terminal end of the tongue engages the extending bead on the tank, inhibiting the lidcage from being lifted from or accidentally knocked off the tank. In the unlocked position, the terminal end is withdrawn from engagement with the extending bead, freeing the lidcage to be lifted from the tank.

In use, a vertically deflecting lock on the latch clasp latches onto an edge on the stationary latch when the tongue is in the locked position and inhibits the tongue from moving to the unlocked position while the lock is in that position. A deflectable actuator tab on the latch clasp projects outwardly from the stationary latch, and can be deflected downwardly by a user to release the lock from the edge. A lower finger edge is spaced from the actuator tab in a position where a user may engage it with one finger while pressing the actuator tab with another finger on the same hand. Once the lock is released, a second deflectable tab can be used to move the latch clasp from the unlocked position to the locked position.

BRIEF DESCRIPTION OF THE DRAWINGS

The invention may be better understood by referring to the accompanying drawings, in which:

FIGS. 4A-6A are further enlarged corresponding views of an alternate stationary latch.

DETAILED DESCRIPTION

Figure 1:
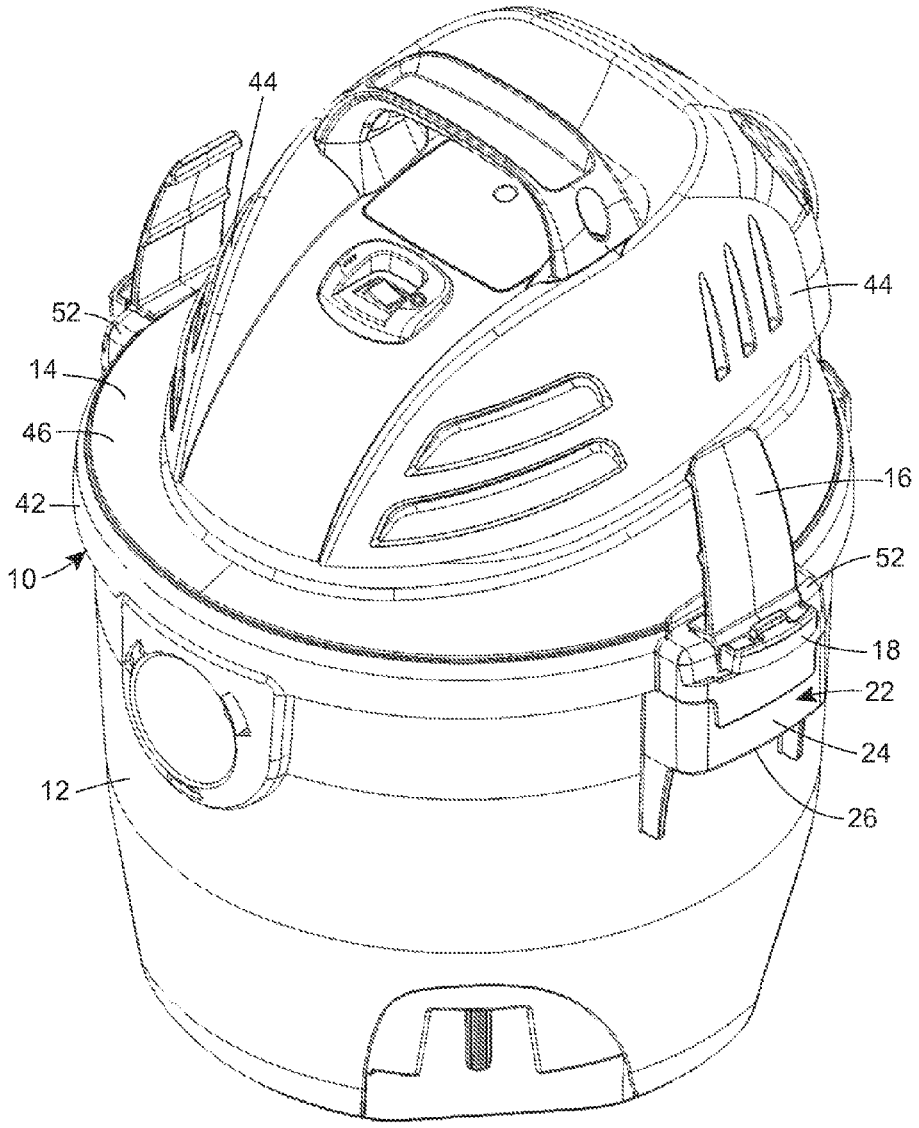
FIG. 1 is an isometric view of one embodiment of a vacuum cleaner that uses the invention.

As seen in FIG. 1, the new vacuum cleaner 10 has a tank 12, a removable lidcage 14, and a latch made up of a stationary latch 16 and a latch clasp 18.

The Tank

The tank 12 is a conventional one. It is made of molded plastic, has a round cross-section, and holds 1-20 gallons of liquid, or an equivalent volume of dirt and debris. Metal tanks can also be used. A bead 20 (seen in FIGS. 2 and 3) extends outwardly from the upper end of the tank. The illustrated bead extends around the entire periphery of the tank and projects outwardly from the rest of the tank. In other examples, the bead may extend around only parts of the tank, and may take other forms, such as a top edge of a groove in the tank wall.

The tank 10 may have wheels or casters, as known in the art.

The illustrated tank 10 has a pair of opposed latch lower bases 22, which, in the prior art, serve as bases for a prior art latch. These latch bases extend outwardly from the tank, and each include a wall 24 that has a horizontal lower edge 26 (FIG. 1).

The Lidcage

The removable lidcage 14 is also a conventional one. It is also made of molded plastic, and has a skirt 42 (FIG. 1) that covers the bead 20 on the tank 12 when the lidcage is fitted on the tank. In other arrangements, the lidcage may cover only part of the bead. The lidcage also has walls 44 that house a vacuum source, such as a motor and impeller as is known in the art. In this example, the walls that house the vacuum source extend above a lidcage deck 46. In other examples, the vacuum source may be housed lower, in some cases below the upper rim of the tank 12.

The illustrated lidcage 14 has a pair of opposed latch upper bases 52 that extend outwardly away from the skirt 42. When placing the lidcage on the tank 12, the upper latch bases are aligned with the lower latch bases 22.

Figure 2:
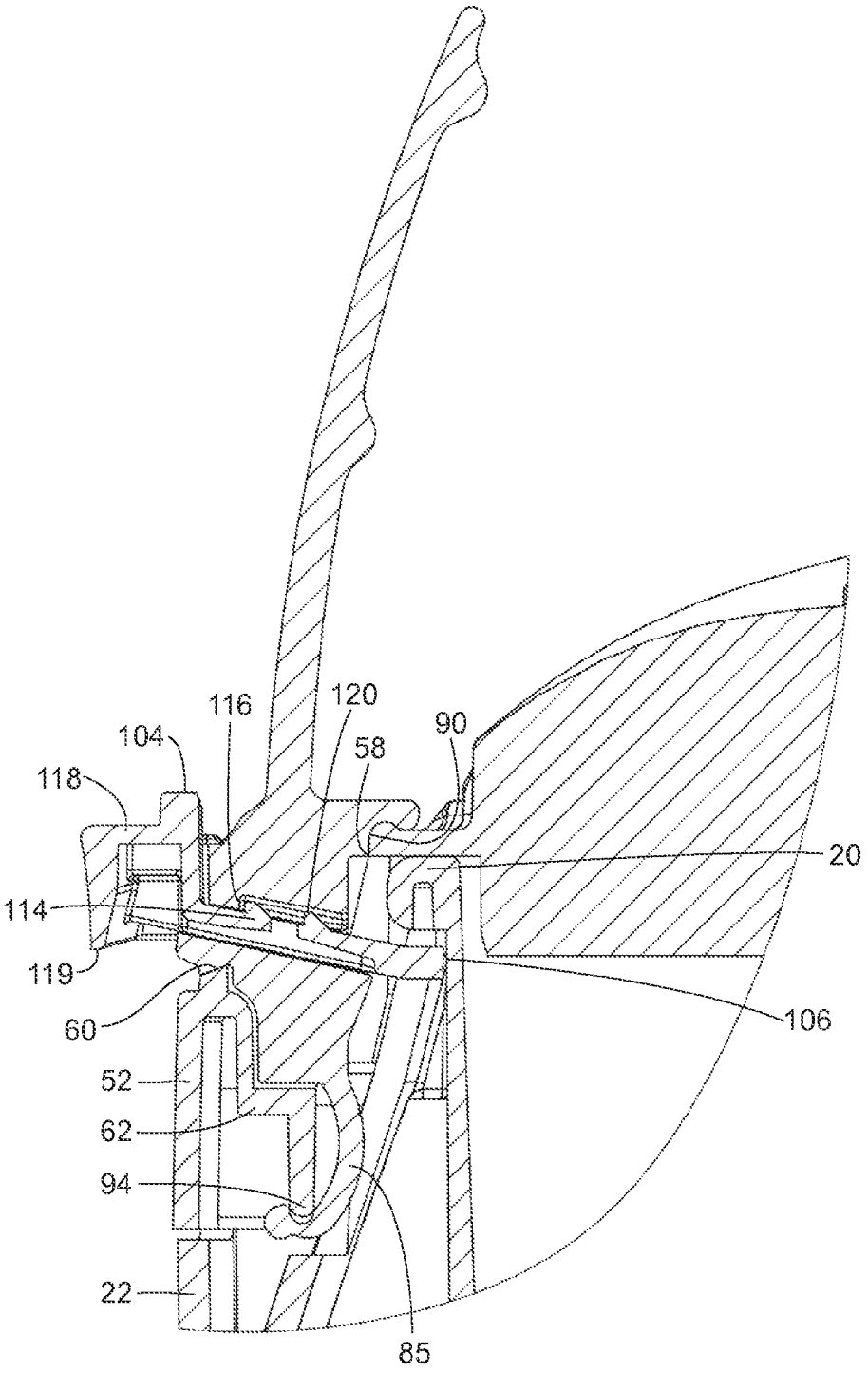
FIG. 2 is a partial cross-sectional view through the latch of the vacuum cleaner when it is in a locked position.
Figure 3:
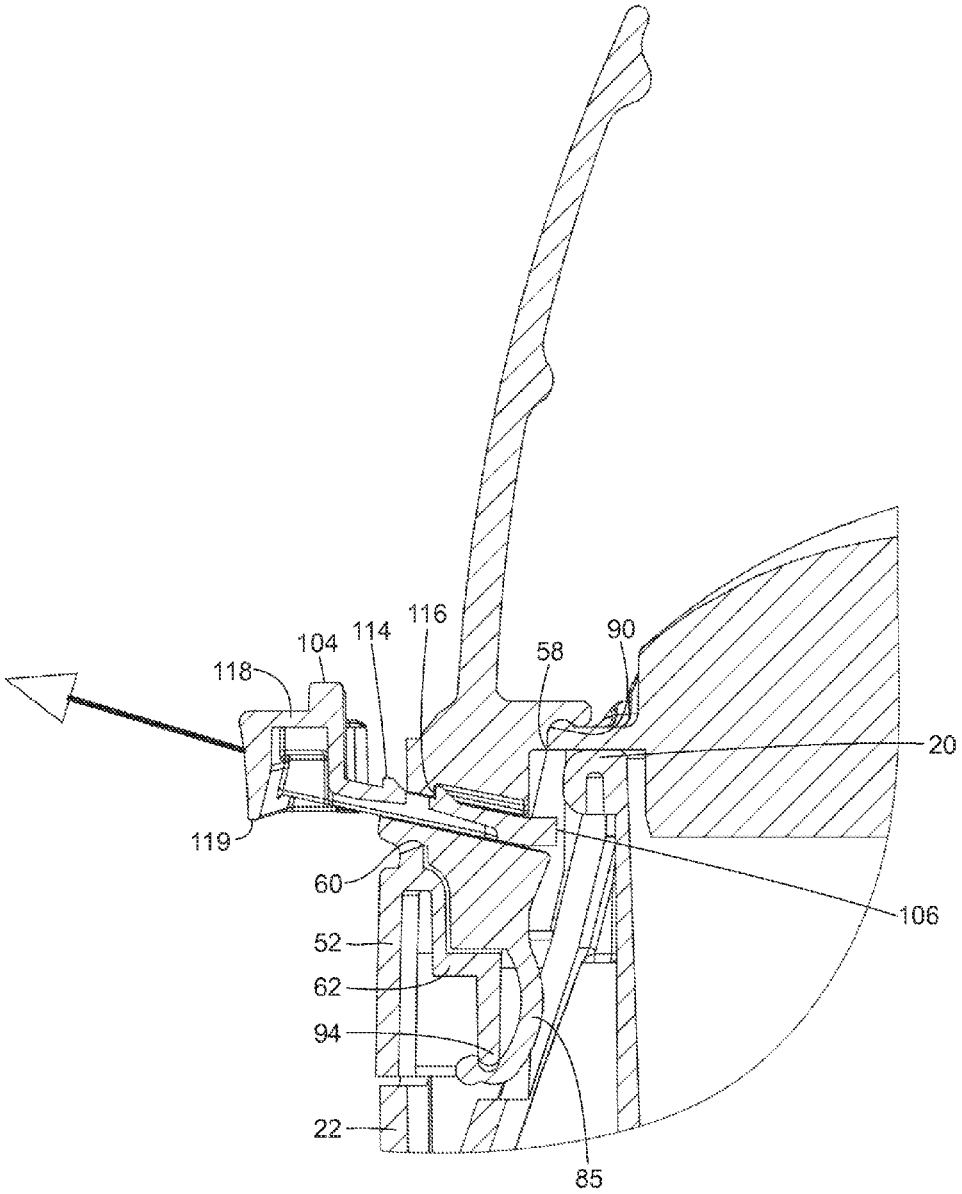
FIG. 3 is a similar cross-sectional view when the vacuum cleaner is in the unlocked position.

The upper latch bases 52 have openings that are by outer peripheral surfaces on the lidcage 14. In the prior art, these openings would be used for latching the lidcage to the tank. As seen in FIGS. 2 and 3, the illustrated openings are bordered by top and bottom edges 58, 60 that are spaced a distance apart. In many cases, it will be preferable for these edges to be parallel. As best seen in FIGS. 2 and 3, the illustrated openings each also have a seat 62 that extends downwardly and inwardly from the bottom edge 60. The seat is configured to flex inwardly or outwardly with respect to the rest of the lidcage. Other shapes and configurations have been and could be used, but the shape and configuration of the opening (and its associated walls and surfaces) will affect shape and configuration of the stationary latch 16.

The Stationary Latches

Figure 4:
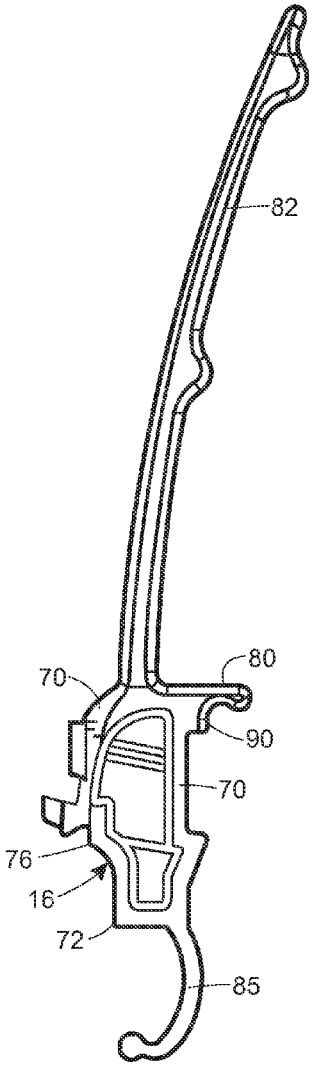
FIGS. 4-6 are an enlarged side view, an enlarged back view, and an enlarged back isometric view of the stationary latch used on the vacuum cleaner.
Figure 5:
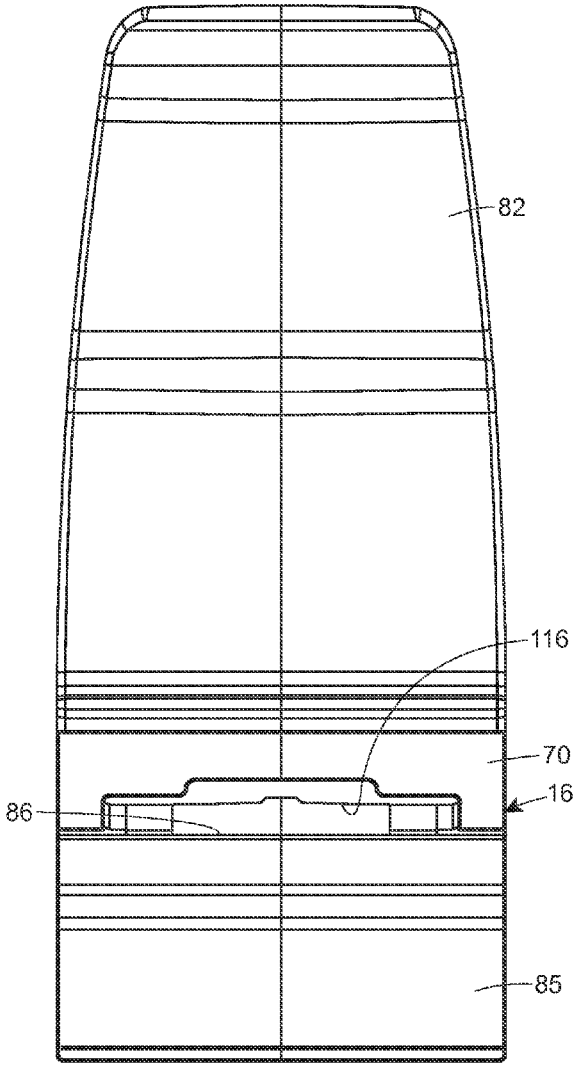
Figure 4A:
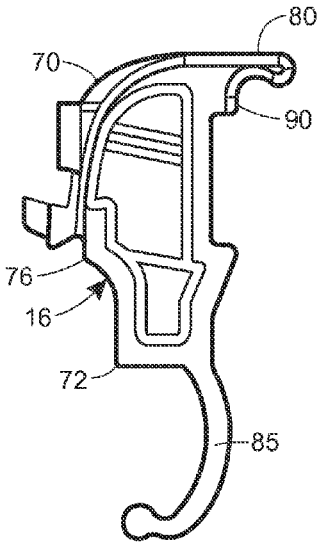
Figure 6A:
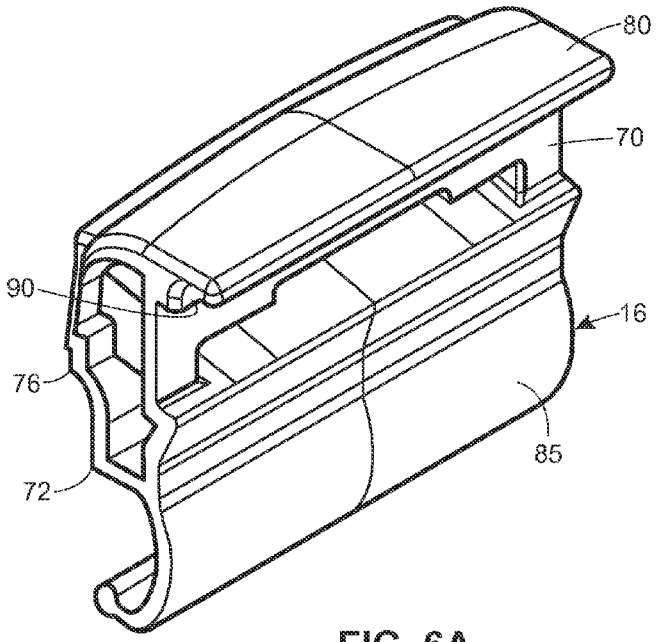
Figure 6:
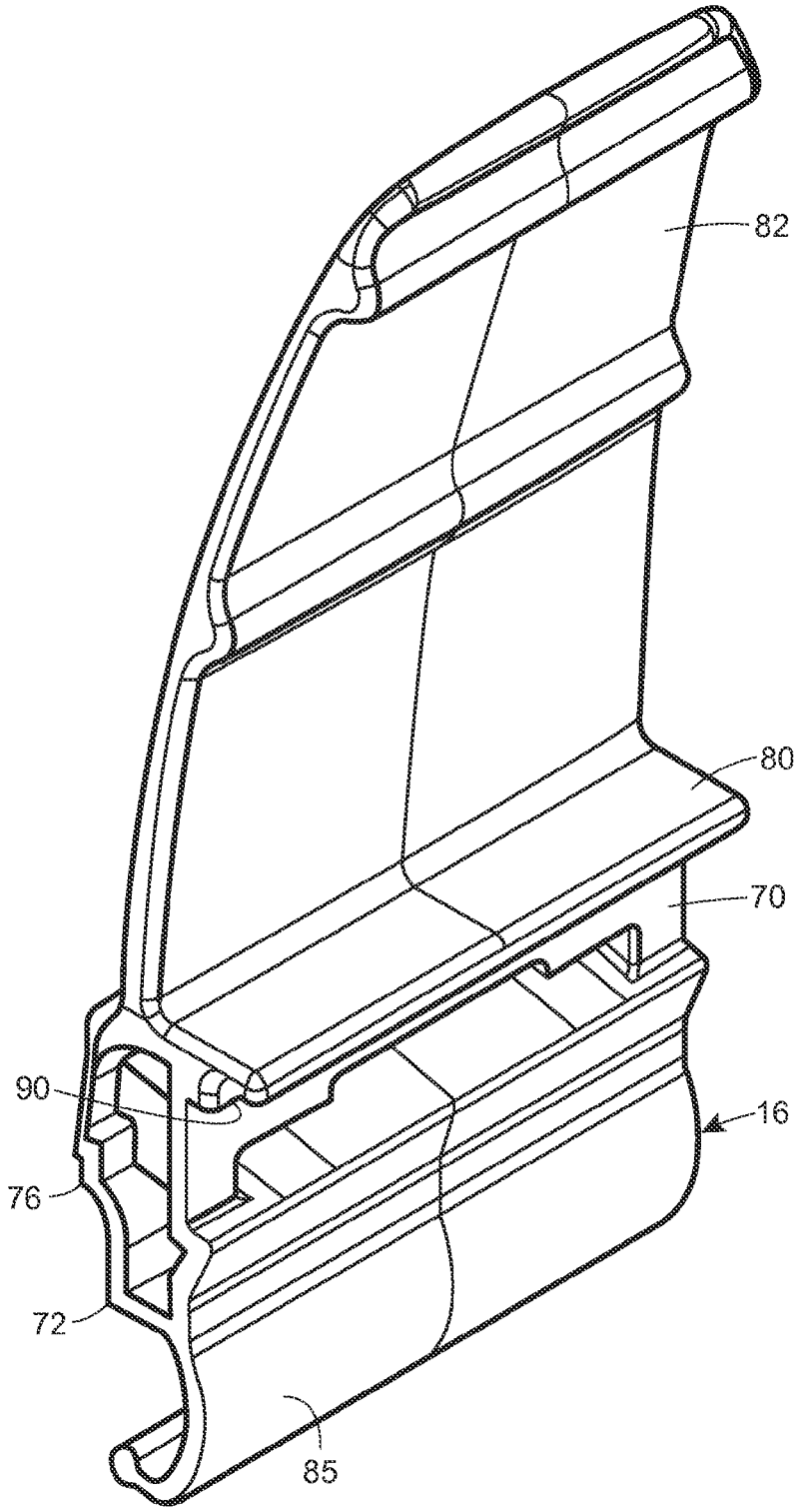

Each of the two stationary latches 16 clips in place in one of the openings on the upper latch bases 52 on the lidcage 14, and is not intended to be removable by the consumer after purchase. For use with the illustrated prior art lidcage, the new stationary latch, best seen in FIGS. 4-6, is an integrally molded plastic piece that has a main body 70 with a corner 72 on the lower part of its outer side. Above the corner, there is a shallow edge 76. On the upper part of the inner side 78 of the main body, a support arm 80 extends inwardly. An optional hose fence 82 extends vertically upwardly from an upper side of the main body, and a resilient hooked arm 85 extends downwardly from the lower side of the main body, hooking outwardly at its bottom.

With the illustrated embodiment, it is preferable that the distance between the inner and outer sides of the main body be closer together than the distance between the top and bottom edges 58, 60 on the opening 54 on the lidcage 14. During assembly, one side of the main body 70 of the stationary latch 16 (generally, either the upper side or the lower side) is passed through the opening in the lidcage, and then the secondary latch is clipped in place with the corner 72 seating in the seat 62 on the lidcage, the edge 76 fitting against the peripheral surface of the lidcage bordering the bottom edge 60 of the opening, a second edge 90 on the support arm 80 fitting against the peripheral surface bordering the top edge 58 of the opening, and a terminal end of the resilient hooked arm 85 deflecting over and then locking with a terminal edge on a depending leg 94 on the seat on the lidcage. This arrangement enables each stationary latch to be clipped in place on the lidcage without the use of other fasteners.

Once the stationary latch 16 is in place, the interaction between the edges 76 and 90, and the resilient hooked arm 85 on the stationary latch and the complementary surfaces and edges on the opening 54 of the lidcage 14 hold and lock the stationary latch against the exterior of the lidcage, subsequently inhibiting the stationary latch from being removed from the lidcage.

The use of this type of stationary latch provides a host of benefits. First, the latch fits onto a conventional lidcage. Consequently, the manufacturer has increased flexibility in the type of latch that can be used on its vacuum cleaners, and need not incur the costs of molding and/or stocking a second lidcage. Second, this type of stationary latch arrangement enables the lidcage and the stationary latch to be made of different materials. Consequently, a less expensive material might be used for one part or the other, and, for product aesthetics, different colors can be used without the need for painting, etc.

The hose fence 82, if provided, extends vertically upwardly above the upper end of the tank 12, and defines a hose space between the hose fence and the walls 44 that encompass the vacuum source. When a consumer uses this space for storing a hose for the vacuum cleaner, the hose fence helps to retain the hose in place.

Figure 5A:
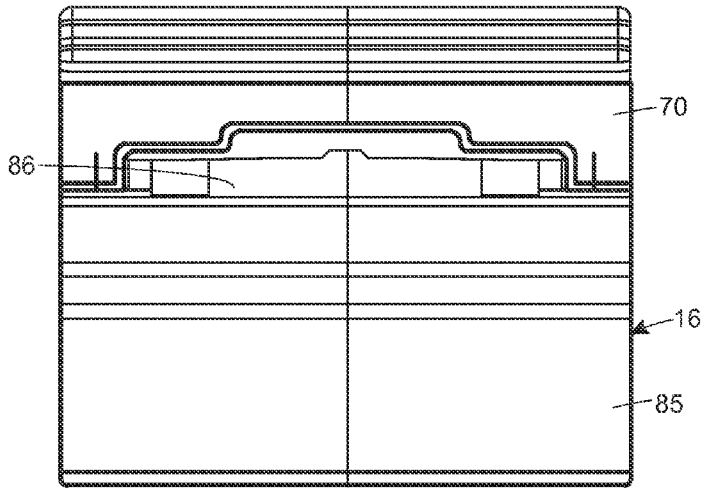

As seen in FIGS. 5 and 5A, the main body 70 of the stationary latch 16 has a channel 86 that extends from the inner side through to the outer side of the main body. This channel accommodates the latch clasp 18.

The Latch Clasp

Figure 7:
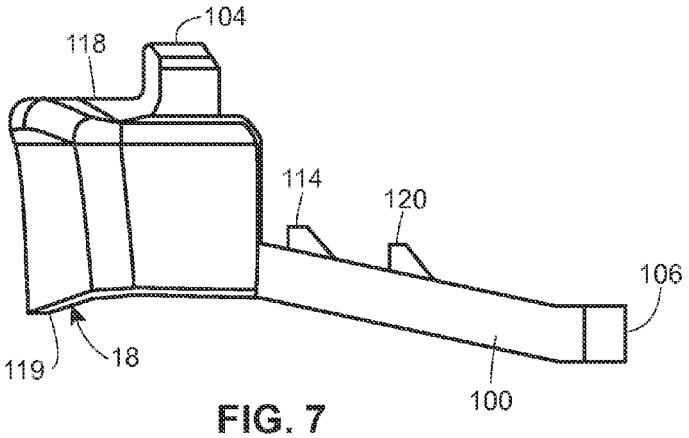
FIGS. 7-9 are an enlarged side view, an enlarged back view, and an enlarged back isometric view of the latch clasp used on the vacuum cleaner.
Figure 8:
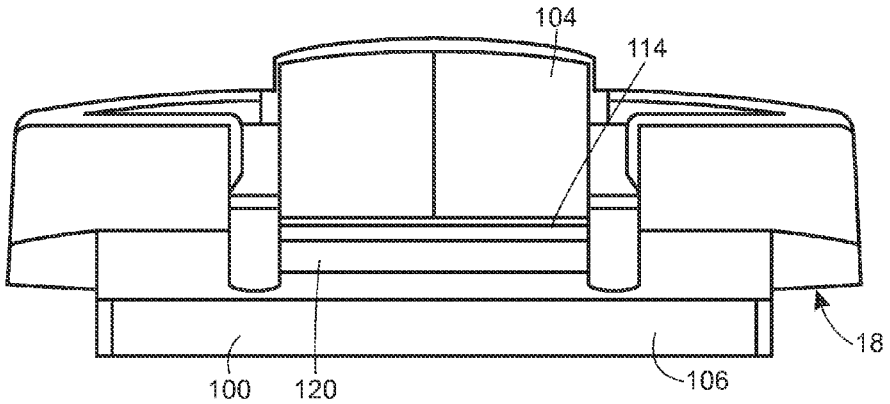
Figure 9:
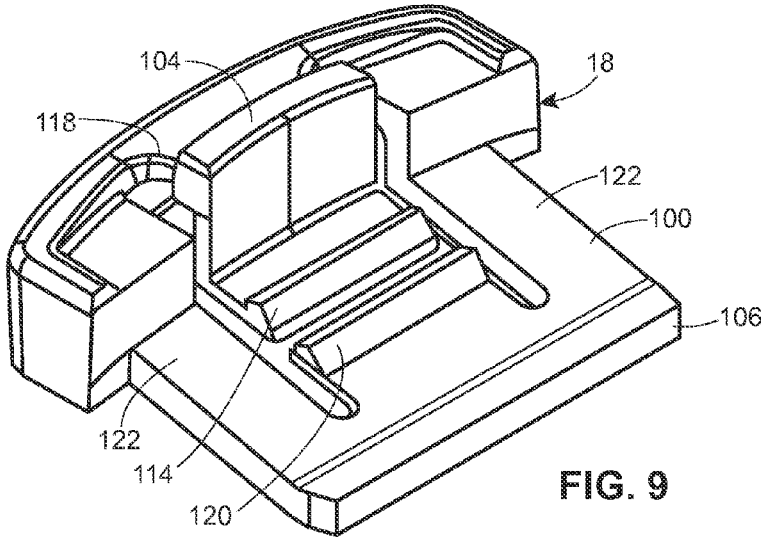

As best seen in FIGS. 7-9, the latch clasp 18 of this embodiment of the invention has a tongue 100 and an actuator tab 104.

The tongue 100 mounts within the channel 86 on the stationary latch 16 for sliding movement along a length of the channel 86 between a locked position (illustrated in FIG. 2) and an unlocked position (illustrated in FIG. 3).

In the locked position, a terminal end 106 of the tongue 100 engages the extending bead 20 on the tank 12, inhibiting the lidcage 14 from being lifted from the tank. In this example, the tongue engages the bead by sliding under the bead. Other arrangements could be used. For example, the bead could be provided with a slot and the tongue could slide into the slot. Alternatively, the tongue might press or otherwise move another part into a locking position. The illustrated arrangement is advantageous because it has only one moving part.

In the unlocked position (FIG. 3), the terminal end 106 of the tongue 100 is withdrawn from engagement with the extending bead 20, freeing the lidcage 14 to be lifted from the tank 12. In this example, moving the tongue to the unlocked position withdraws the tongue from under the bead 20, removing the impediment to the lidcage being lifted from the tank.

Outward movement of the latch clasp 18 from the locked position is initially inhibited by a lock 114 on the actuator tab 104. When the latch clasp is locked (as seen in FIG. 2), that lock latches onto a locking edge 116 on the stationary latch. Pressing the actuator tab disengages the lock from the locking edge, freeing the tongue 100 to be moved outwardly from the locked position to the unlocked position.

Although other arrangements can be used, the illustrated actuator tab 104 takes the form of a third class lever, with the portion of the tab engaged by a user being positioned between a hinge 118 and the lock 114. The illustrated lock 114 faces up, and latches onto a downward-facing locking edge 116. When the latch clasp 18 is in the locked position, the actuator tab is disposed outside the channel 86 and can be pressed vertically by a user. Pressing the tab downwardly moves the lock downwardly, and out of engagement with the locking edge 116 on the stationary latch 16.

A lower finger edge 119 on the latch clasp 18 is spaced from the actuator tab 104 in a position where a user may engage it with one finger while pressing the actuator tab with another finger on the same hand. In this example, the lower finger edge is positioned beneath the proximal edge of the actuator tab.

A barb 120 on the tongue 100 resists removal of the tongue from the channel 86 after the tongue has been mounted in the channel. In the illustrated example, the tongue has two parts, with the actuator tab 104 being on an inner part of the tongue and arms 122 being on a separate, laterally outer part. The illustrated barb is on a tongue end that extends between the distal ends of the two arms. When the latch clasp 18 is assembled with the stationary latch 16, the arms flex, enabling the barb to deflect past the locking edge 116 in the channel. Once the barb passes the locking edge, it returns to an undeflected position (seen in FIG. 3). In that position, interference between the barb and the locking edge prevents the latch clasp from being inadvertently fully removed from the stationary latch.

The position of the barb 120 on a part of the tongue 100 that is separated from the part of the tongue that bears the actuator tab 104 (i.e., on the other side of the hinge 118) minimizes movement of the barb when the actuator tab is depressed, and helps ensure that the barb latches onto the locking edge even when the actuator tab is depressed.

With the assembled product, a user can lock the lidcage 14 in place on the tank 12 by pressing the actuator tab 104 downwardly until the terminal end 106 of the outer part of the tongue 100 slides under the bead 20 and the lock 114 deflects past and then latches onto the locking edge 116. One advantage of this arrangement is that, in some embodiments, specific rotational alignment of the lidcage and the tank may not be required because the locking engagement can occur on a bead that extends all the way (or most of the way) around the tank, rather than requiring alignment of upper and lower latch bases.

Other arrangements are possible. For example, the lock 114 could be arranged to face downwardly (or to a lateral side) and latch onto an upward facing (or sideways-facing) locking edge 116. In those cases, the actuator tab 104 may be arranged to be move upwardly or sideways for unlocking. The barb 120 or an equivalent structure like a pin, bar, or tab could lock onto another edge of the channel 86, or on to some other part of the stationary latch 18 or the lidcage 12. Alternatively, the barb could be on the stationary latch and the locking edge could be on the latch clasp.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner that has:

a tank that has an open upper end and an extending bead;

a removable lidcage that houses a vacuum source, fits on the tank, closes the open upper end of the tank, and covers at least part of the extending bead when the lidcage is fitted on the tank;

a stationary latch that is on the lidcage and has a channel; and a latch clasp that has:

a tongue that mounts within the channel for sliding movement along a length of the channel between a locked position in which a terminal end of the tongue engages the extending bead, inhibiting the lidcage from being lifted from the tank, and an unlocked position in which the terminal end is withdrawn from engagement with the extending bead, freeing the lidcage to be lifted from the tank;

a lock that latches onto an edge on the stationary latch when the tongue is in the locked position and inhibits the tongue from moving to the unlocked position while latched; and one or more deflectable tabs that project outwardly from the stationary latch and can be deflected by a user to release the lock, enabling the latch clasp to be moved from the locked position to the unlocked position.

2. A vacuum cleaner as recited in claim 1, in which:

the stationary latch clips in place on the lidcage.

3. A vacuum cleaner as recited in claim 1, in which:

the stationary latch clips into an opening on a skirt of the lidcage that covers at least part of the extending bead when the lidcage is fitted on the tank.

4. A vacuum cleaner as recited in claim 1, in which the stationary latch has:

two spaced edges that fit against outer peripheral surfaces on the lidcage and hold the stationary latch to the lidcage; and a resilient hooked arm that deflects over and then locks against an interior edge on the lidcage, subsequently inhibiting the stationary latch from being withdrawn from the lidcage and thus enabling each stationary latch to be clipped in place on the lidcage without the use of other fasteners.

5. A vacuum cleaner as recited in claim 1, in which a pair of stationary latches each have a hose fence that extends vertically upwardly above the open end of the tank, defining a hose space in which a hose can be mounted between the hose fences and walls that encompass the vacuum source.

6. A vacuum cleaner as recited in claim 1, in which:

the latch clasp has a barb on the tongue that resists removal of the tongue from the channel in the stationary latch after the tongue has been mounted in the channel.

7. A vacuum cleaner as recited in claim 1, in which:

the latch clasp has a deflecting barb on the tongue that engages the same edge that the lock latches onto, inhibiting removal of the tongue from the channel in the stationary latch after the tongue has been mounted in the channel.

8. A vacuum cleaner as recited in claim 1, in which:

at least one of the one or more resilient tabs is an actuator tab that is arranged to be deflected downwardly by a user to release the lock from the edge, enabling the latch clasp to be moved from the locked position to the unlocked position; and the latch clasp has a lower finger edge that is spaced from the actuator tab in a position where a user may engage it with one finger while pressing the actuator tab with another finger on the same hand.

9. A vacuum cleaner that has:

a tank that is configured to hold dirt and debris, has opposed, outwardly extending latch lower bases, has an open upper end, and has an extending bead that projects from beneath the open upper end and above an upper side of the latch bases;

a molded removable lidcage that houses a vacuum source and has tank walls, fits on and removably closes the open upper end of the tank, has a downwardly extending skirt that covers the extending bead when the lidcage is fitted on the tank, has outwardly extending latch upper bases that align with the latch lower bases on the tank and are spaced outwardly from upright walls that encompass the vacuum source, and has openings in the latch upper bases;

molded stationary latches that are made of resilient material, fit into the openings on the removable lidcage, each have a channel that extends from an exterior surface of the stationary latch to an interior surface of the stationary latch, each have a hose fence that extends vertically upwardly above the open end of the tank, defining a hose space in which a hose can be stored between the hose fence and the walls that encompass the vacuum source, each have two aligned edges that fit against outer peripheral edges of one of the opening on the removable lidcage and hold the stationary latch against the exterior of the lidcage, and each have a resilient hooked arm that deflects over and then locks against an interior edge on the stationary latch, subsequently inhibiting the stationary latch from being withdrawn from the removable lidcage and thus enabling each stationary latch to be clipped in place in one of the openings on the removable lidcage without the use of other fasteners; and latch clasps that each have:

a two-part tongue that has an inner part and a separate outer part, and mounts within the channel for sliding movement in a generally horizontal plane along the length of the channel between (a) a locked position in which a terminal end of the latch clasp engages the extending bead, inhibiting the lidcage from being lifted from the tank, and (b) an unlocked position in which the terminal end is withdrawn from engagement with the extending bead, freeing the lidcage to be lifted from the tank;

a barb on the outer part of the tongue that resists removal of the tongue from the channel after the tongue has been mounted in the channel;

a releasable lock on the inner part of the tongue that latches onto an edge on the channel when the latch clasp is in the locked position and inhibits the latch clasp from moving outwardly when in that position; and a resilient tab connected to the inner part of the tongue that extends outwardly from the channel in the stationary latch and can be deflected by a user to release the lock from the edge, enabling the latch clasp to be moved from the locked position to the unlocked position.

10. A vacuum cleaner that has:

a tank that has an open upper end;

a removable lidcage that houses a vacuum source, fits on the tank, and closes the open upper end of the tank;

a pair of stationary latches that are on the lidcage and each have a hose fence that extends vertically upwardly above the open end of the tank, defining a hose space in which a hose can be mounted between the hose fences and walls that encompass the vacuum source;

a latch clasp that is mounted to one of the stationary latches and has an element that moves between a locked position in which the lidcage is inhibited from being lifted from the tank, and an unlocked position in which the lidcage is free to be lifted from the tank; and a two-part tongue that is on the latch clasp, with one part having an actuator tab and a lock that holds the latch clasp in the locked position, and the other part having a barb that inhibits the latch clasp from being fully removed from the stationary latch, the two parts of the tongue being separated by a hinge.

* * * * *